US010644417B2

(12) United States Patent
Balcer et al.

(10) Patent No.: US 10,644,417 B2
(45) Date of Patent: May 5, 2020

(54) ROTATE-TO-CLOSE CONNECTOR FOR A COAXIAL CABLE

(71) Applicant: Corning Optical Communications RF LLC, Glendale, AZ (US)

(72) Inventors: Anders Balcer, Vordingborg (DK); Michael Ole Matzen, Vordingborg (DK); Michael Meister, Langebaek (DK); Thomas Dewey Miller, Peoria, AZ (US); Jens Petersen, Vordingborg (DK); Nikolaj Slobodziuk, Vordingborg (DK)

(73) Assignee: Corning Optical Communications RF LLC, Glendale, AZ (US)

( * ) Notice: Subject to any disclaimer, the term of this patent is extended or adjusted under 35 U.S.C. 154(b) by 69 days.

(21) Appl. No.: 15/812,477

(22) Filed: Nov. 14, 2017

(65) Prior Publication Data

US 2018/0138603 A1 May 17, 2018

Related U.S. Application Data

(60) Provisional application No. 62/422,259, filed on Nov. 15, 2016.

(51) Int. Cl.

| | |
|---|---|
| ***H01R 9/05*** | (2006.01) |
| ***H01R 9/053*** | (2006.01) |
| ***H01R 13/58*** | (2006.01) |
| ***H01R 13/02*** | (2006.01) |

(Continued)

(52) U.S. Cl.

CPC ..... *H01R 9/053* (2013.01); *H01R 9/0524* (2013.01); *H01R 13/025* (2013.01);

(Continued)

(58) Field of Classification Search

CPC ..... H01R 9/05; H01R 9/053; H01R 13/025; H01R 13/422; H01R 13/426;

(Continued)

(56) References Cited

U.S. PATENT DOCUMENTS

| | | | |
|---|---|---|---|
| 3,706,958 | A | 12/1972 | Blanchenot |
| 4,834,675 | A | 5/1989 | Samchisen |

(Continued)

OTHER PUBLICATIONS

Matzen et al, "Connector for a Coaxial Cable" Filed as U.S. Appl. No. 15/797,393 filed Oct. 30, 2017; 31 Pages.

(Continued)

*Primary Examiner* — Hae Moon Hyeon

(74) *Attorney, Agent, or Firm* — Tamika A. Crawl-Bey

(57) ABSTRACT

A coaxial cable connector for attachment to an end of a coaxial cable is disclosed. The coaxial cable connector includes a rotatable body segment having a body wall with an outer surface and an inner surface defining a width of the body wall. The body wall has a radial dimension which varies along a perimeter of the rotatable body segment. The inner surface defines a longitudinal opening extending between a forward end of the rotatable body segment and a rearward end of the rotatable body segment. A post positions proximal the forward end of the rotatable body segment. The post has a first end and a second end with a bore extending therebetween. The post is rotationally stationary with respect to the rotatable body segment. A coupling member positions proximal to the first end of the post. The rotatable body segment is rotated to close the coaxial cable connector.

21 Claims, 10 Drawing Sheets

(51) Int. Cl.

| | |
|---|---|
| ***H01R 13/422*** | (2006.01) |
| ***H01R 13/426*** | (2006.01) |
| ***H01R 13/502*** | (2006.01) |
| *H01R 4/50* | (2006.01) |
| *H01R 103/00* | (2006.01) |

(52) U.S. Cl.
CPC ..... *H01R 13/422* (2013.01); *H01R 13/426* (2013.01); *H01R 13/502* (2013.01); *H01R 13/582* (2013.01); *H01R 4/5041* (2013.01); *H01R 2103/00* (2013.01)

(58) Field of Classification Search
CPC ..... H01R 13/502; H01R 24/38; H01R 24/56; H01R 9/0518; H01R 4/18
USPC ..... 439/220, 578
See application file for complete search history.

(56) References Cited

U.S. PATENT DOCUMENTS

| | | | | |
|---|---|---|---|---|
| 5,342,218 | A | 8/1994 | McMills et al. | |
| 5,632,651 | A | 5/1997 | Szegda | |
| 5,879,191 | A | 3/1999 | Burris | |
| 6,089,912 | A | 7/2000 | Tallis et al. | |
| 7,288,002 | B2 | 10/2007 | Rodrigues et al. | |
| 7,303,435 | B2 | 12/2007 | Burris et al. | |
| 7,371,113 | B2 | 5/2008 | Burris et al. | |
| 8,075,339 | B2 | 12/2011 | Holliday | |
| 2002/0013088 | A1* | 1/2002 | Rodrigues | H01R 9/0521 439/578 |
| 2004/0031144 | A1 | 2/2004 | Holland | |
| 2008/0003873 | A1* | 1/2008 | Henningsen | H01R 9/0521 439/578 |
| 2012/0270439 | A1* | 10/2012 | Tremba | H01R 9/0524 439/578 |
| 2016/0036138 | A1 | 2/2016 | Burris et al. | |
| 2018/0131139 | A1* | 5/2018 | Matzen | H01R 13/6593 |
| 2018/0131143 | A1* | 5/2018 | Balcer | H01R 13/5825 |

OTHER PUBLICATIONS

International Search Report and Written Opinion PCT/US2017/061510 dated Feb. 9, 2018.

* cited by examiner

ROTATE-TO-CLOSE CONNECTOR FOR A COAXIAL CABLE

CROSS-REFERENCE TO RELATED APPLICATION

This application claims the benefit of priority of U.S. Provisional Application Ser. No. 62/422,259, filed Nov. 15, 2016, the content of which is relied upon and incorporated herein by reference in its entirety.

FIELD

The disclosure relates generally to coaxial cable connectors, including F-type coaxial cable connectors, for use with minimally prepared coaxial cables, including a coaxial cable connector that tool-lessly attaches to the end of a coaxial cable by rotating the coaxial cable connector.

BACKGROUND

Coaxial cable connectors, such as F-connectors, are used to attach coaxial cables to another object such as an appliance or junction having a terminal adapted to engage the connector. For example, F-connectors are often used to terminate a drop cable in a cable television system. The coaxial cable typically includes an inner conductor surrounded by a dielectric layer, which is in turn surrounded by an outer conductor in the form of a conductive grounding foil and/or braid defining an outer conductive grounding sheath. The outer conductive grounding sheath is itself surrounded by a protective outer jacket. The F-connector is typically secured over the prepared end of the jacketed coaxial cable, allowing the end of the coaxial cable to be connected with a terminal block, such as by a threaded connection with a threaded terminal of a terminal block.

In the case of most of the types of connectors the coaxial cable must be prepared by stripping back the outer jacket to expose the outer conductive grounding sheath and inner conductor, then further requires that the outer conductive grounding sheath be folded back, or everted. The folded back or everted outer conductive grounding sheath facilitates the electrical continuity with the coaxial cable connector when the coaxial cable is installed thereon. In this manner, grounding continuity from the coaxial cable through the coaxial cable connector to the terminal block may be established. Without such effective grounding continuity, spurious signals may compromise the quality or effectiveness of the signals being transmitted by the coaxial cable. However, since the conductive grounding sheath typically is a braided metallic material, the step of flaring and folding the conductive grounding sheath over the outer jacket is a difficult, time consuming and painstaking process. Further, the preparation of the coaxial cable is typically performed manually by an installer using hand tools, and as such, the results of such preparation may not be consistent between different installers or different coaxial cable connectors. As a non-limiting example, small fragments of the outer braid may break off, affecting the grounding continuity or possibly causing an electrical short in the coaxial cable connector or other nearby electrical systems. Additionally, due to the need to manually perform the coaxial cable preparation, the small fragments may cut and/or enter the skin of the cable installer resulting in a safety or health concern.

Once the coaxial cable is prepared, it is installed in the coaxial cable connector in a manner so that the post is inserted under the jacket of the coaxial cable. Next the coaxial cable connector is axially compressed using a compression tool. The axial compression of the coaxial cable connector causes an internal component to move radially inwardly and compress against the outer surface of the jacket. A number of manufacturers provide compression tools for axially compressing a cable connector. Such compression tools are hand tools requiring the installer to correctly manipulate the tool to provide the necessary axial compression force to result in the appropriate radial inward compression of the internal component. Accordingly, the need to prepare the coaxial cable and the attendant issues involving such preparation as noted above, and the requirement to compress the coaxial cable connector using a compression tool, takes time and patience when installing a coaxial cable connector on the end of a coaxial cable.

Consequently, there is an unresolved need for a coaxial cable connector that attaches to the coaxial cable without requiring the flaring, folding back or everting of the braided outer conductive grounding sheath of the coaxial cable and without requiring the use of a compression tool.

No admission is made that any reference cited herein constitutes prior art. Applicant expressly reserves the right to challenge the accuracy and pertinence of any cited documents.

SUMMARY

One embodiment of the disclosure relates to a coaxial cable connector for attachment to an end of a coaxial cable, the coaxial cable comprising an inner conductor, a dielectric surrounding the inner conductor, an outer conductor surrounding the dielectric, and a jacket surrounding the outer conductor. The coaxial cable connector comprises a rotatable body segment comprising a body wall having an outer surface and an inner surface defining a width of the body wall therebetween, wherein the body wall has a radial dimension and wherein the radial dimension varies along a perimeter of the rotatable body segment, and wherein the inner surface defines a longitudinal opening extending between a forward end of the rotatable body segment and a rearward end of the rotatable body segment. The coaxial cable connector also comprises a post positioned proximal the forward end of the rotatable body segment, wherein the post comprises a first end and a second end with a bore extending therebetween, and wherein the post is rotationally stationary with respect to the rotatable body segment. The coaxial cable connector also comprises a coupling member positioned proximal to the first end of the post, wherein the rotatable body segment is rotated to close the coaxial cable connector.

Another embodiment of the disclosure relates to a coaxial cable connector for attachment to an end of a coaxial cable. The coaxial cable comprises an inner conductor, a dielectric surrounding the inner conductor, an outer conductor surrounding the dielectric, and a jacket surrounding the outer conductor. The coaxial cable connector also comprises a rotatable body segment comprising a body wall having an outer surface and an inner surface defining a width of the body wall, wherein the body wall has a variable width along a perimeter of the rotatable body segment, and wherein the inner surface defines a longitudinal opening extending between a forward end of the rotatable body segment and a rearward end of the rotatable body segment, and wherein the longitudinal opening is centered along a longitudinal opening axis. The coaxial cable connector also comprises a post positioned proximal the forward end of the rotatable body segment, wherein the post comprises a first end and a second end with a bore extending therebetween, and wherein the bore of the post is centered along a longitudinal bore axis, and wherein the post is rotationally stationary with respect to the rotatable body segment. The coaxial cable connector also comprises a coupling member positioned proximal to the first end of the post. In a connector open state, the rotatable body segment is in a first configuration, wherein the variable width of the body wall is in a first orientation along the perimeter of the rotatable body segment. In a connector closed state, the rotatable body segment is in a second configuration, wherein the variable width of the body wall is in a second orientation along a perimeter of the rotatable body segment.

Yet another embodiment of the disclosure relates to a method for tool-lessly attaching a coaxial cable connector to a coaxial cable. The method comprises providing a coaxial cable comprising an inner conductor, a dielectric at least partially surrounding the inner conductor, an outer conductor surrounding the dielectric, and a jacket surrounding the outer conductor. The method further comprises preparing the coaxial cable by exposing a predetermined length of the inner conductor beyond ends of the jacket, the dielectric, and the outer conductor, wherein the ends of the jacket, the dielectric, and the outer conductor remain generally flush with each other. The method further comprises inserting the prepared coaxial cable into a rotatable body segment of a coaxial cable connector proximal to a rearward end of the body, wherein the coaxial cable connector is in a connector open state, and wherein the rotatable body segment is in a first configuration, and wherein a width of a body wall of the rotatable body segment is in a first orientation along a perimeter of the rotatable body segment. The method further comprises advancing the prepared coaxial cable toward a forward end of the rotatable body segment to a post proximal the forward end of the rotatable body segment, wherein a second end of the post inserts under a jacket of the coaxial cable, and wherein the inner conductor, the dielectric, and the outer conductor extend through a bore in the post to a first end of the post. The method further comprises putting the coaxial cable connector in a connector closed state by rotating the rotatable body segment to a second configuration, wherein the width of the body wall is in a second orientation along the perimeter of the rotatable body segment, and wherein the coaxial cable is secured in the coaxial cable connector.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1A:
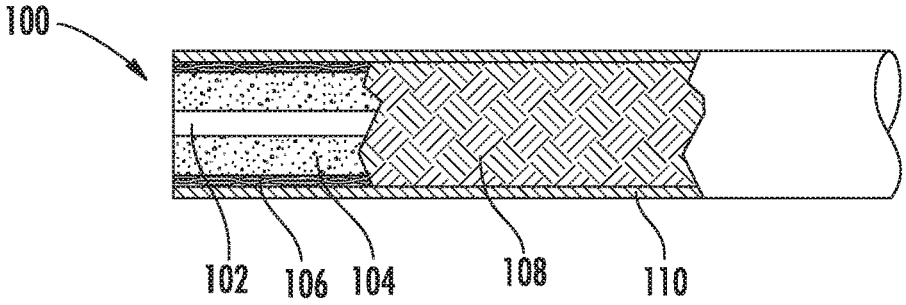
FIG. 1A (Prior Art)
FIG. 1A is a partial cross-section of a coaxial cable useful for description of the various cable constituents.
Figure 1B:
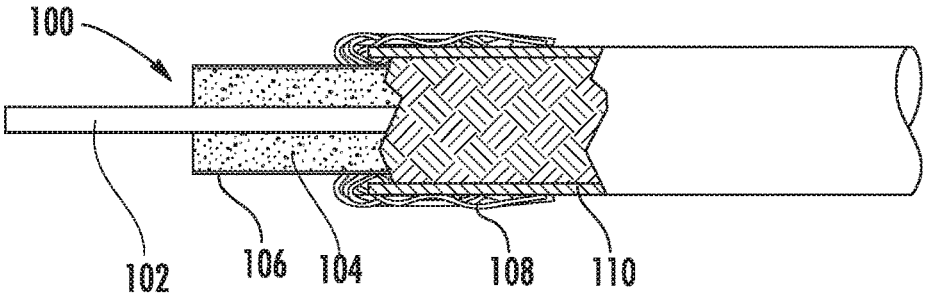
FIG. 1B (Prior Art)
FIG. 1B is a partial cross-section of a coaxial cable prepared using conventional preparation methods.

Referring to FIGS. 1A and 1B, a conventional coaxial cable 100 is illustrated as well as the method in which the end of the coaxial cable 100 is prepared. Referring to FIG. 1A, the coaxial cable 100 has an inner conductor 102 that is surrounded by a dielectric layer 104. The dielectric layer (or dielectric) 104 may also have a foil or other metallic covering 106. The coaxial cable 100 then has a braided outer conductor 108 which is covered and protected by a jacket 110. Typically, to prepare the coaxial cable 100 for attachment to a coaxial cable connector, a portion of the inner conductor 102 is exposed as illustrated in FIG. 1B. The jacket 110 is trimmed back so that a portion of the dielectric 104 (and metallic covering 106 if present) and braided outer conductor 108 are exposed. The braided outer conductor 108 is then folded back, or everted, over the jacket 110, exposing the dielectric 104 and the metallic covering 106.

Figure 1C:
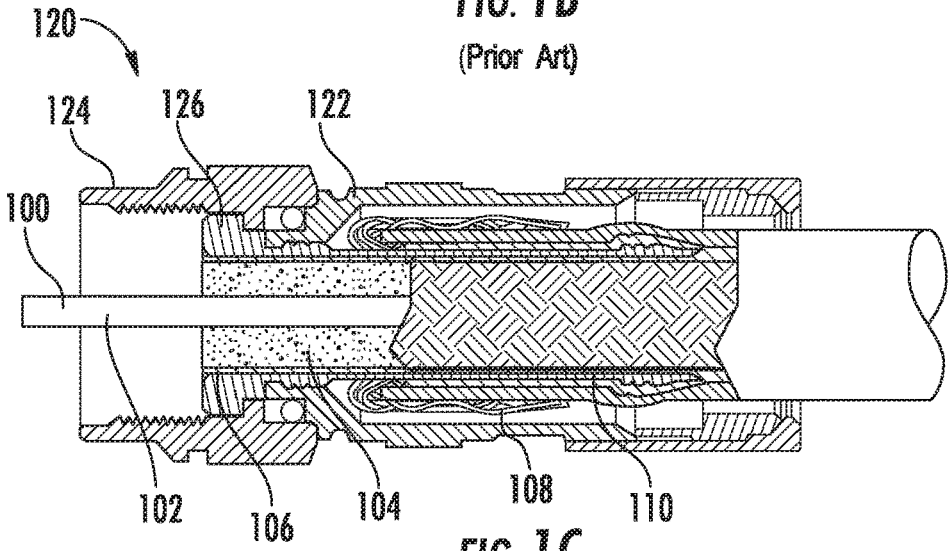
FIG. 1C (Prior Art)
FIG. 1C is a cross-section of a conventional coaxial cable connector utilizing a post with a coaxial cable installed.

FIG. 1C illustrates a conventional coaxial cable connector 120 attached to the prepared coaxial cable 100 of FIG. 1B. The coaxial cable connector 120 has a body portion 122 and a coupling member 124 beyond which the inner conductor 102 extends. Inside the body portion 122 is a post 126. The post 126 is used to secure the coaxial cable 100 to the coaxial cable connector 120 and to establish grounding continuity between the braided outer conductor 108 and the coaxial cable connector 120. As can be seen in FIG. 1C, the post 126 is inserted into the coaxial cable 100 under the jacket 110 between the braided outer conductor 108 and the dielectric 104 and the metallic covering 106. As the post 126 is inserted under the jacket 110, the post 126 physically contacts the braided outer conductor 108, while an exposed length of the dielectric 104 and the metallic covering 106 extends into the post 126 beyond the end of the jacket 110. In this manner, the post 126 is in continuity with the braided outer conductor 108 and the metallic covering 106. Moreover, since the braided outer conductor 108 is folded back over the jacket 110, the body portion 122 also comes in contact with the braided outer conductor 108, resulting in the post 126 and the body portion 122 having electrical continuity with the coaxial cable 100 through the braided outer conductor 108 and/or the metallic covering 106. Since the coupling member 124 may be connected to one or both of the post 126 and the body portion 122, electrical continuity, and thereby grounding continuity, may be extended from the coaxial cable 100 through the coaxial cable connector 120 and to a terminal to which the coupling member 124 may couple.

When discussing coaxial connectors herein, unless otherwise specifically indicated by the text or context of the description, reference to "forward" or "front" shall be understood to mean or indicate toward the end of the coaxial cable connector that couples to a terminal, while reference to "rearward" or "rear" shall be understood to mean or indicate the end of the coaxial cable connector that receives a coaxial cable. In this regard, and as can be seen in FIG. 1C, the post 126 may extend from the coupling member 124 at a forward end of the coaxial cable connector 120 through the body portion 122 and, almost, right up to the rearward end of the coaxial connector 120 where the coaxial cable 100 is received by the coaxial cable connector 120. With this conventional coaxial cable connector 120, a substantial length of a rear portion of the post 126 must be inserted under the jacket 110 to adequately secure and stabilize the cable prior to, during and after closing the coaxial cable connector 120 by compressing the coaxial cable connector 120 with a compression tool. However, sufficient length of the braided outer conductor 108 may have to be exposed and folded back rearwardly to establish and maintain grounding continuity as the post 126 is inserted under the jacket 110 to also assure that grounding continuity is established and maintained during and after attaching the coaxial cable connector 120 to the coaxial cable 100. Additionally, sufficient length of the dielectric 104 has to be exposed beyond the jacket 110 so that the dielectric 104 can insert into the post 126 to the forward end of the post 126 to insulate and separate the inner conductor 102 from the post 126 and prevent grounding the signal transmitted in the inner conductor 102.

Figure 2:
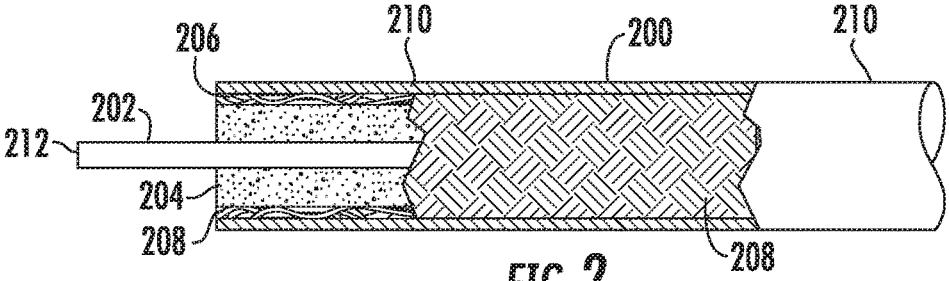
FIG. 2 is a partial cross-sectional view of a prepared coaxial cable using a simpler method of preparation than as illustrated in FIG. 1B.

FIG. 2 illustrates a coaxial cable 200 prepared using a simpler method of preparation as used for coaxial cable 100. The coaxial cable 200 is substantially like the coaxial cable 100 noted above, except for the difference in preparation. As illustrated in FIG. 2, the coaxial cable 200 has a inner conductor 202 that is surrounded by a dielectric layer 204. Coaxial cable 200 then has a braided outer conductor 208 which is covered and protected by a jacket 210. In FIG. 2, the dielectric layer 204 is not visible as it may be cut flush with, and, thereby, covered by, the braided outer conductor 208. The dielectric layer (or dielectric) 204 may also have a foil or other metallic covering 206 (also covered by braided outer conductor 208). The braided outer conductor 208 is illustrated as having a parquet-floor-like pattern, but it may be any outer conductor. From an end 212 of the coaxial cable 200, the inner conductor 202 is exposed by removing the dielectric layer 204, the foil or other metallic covering 206, the braided outer conductor 208 and the jacket 210. In other words, the ends of the jacket 210, dielectric layer 204, metallic covering 206 and braided outer conductor 208 are cut and remain generally flush with each other. As noted above, the conventional method of preparing the coaxial cable 200 required that the braided outer conductor 208 be folded back over the jacket 210. In this embodiment, the braided outer conductor 208 does not have to be folded back, or everted, over the jacket 210. Accordingly, preparing coaxial cable 200 is much simpler, requiring less time and avoiding possible safety and health concerns and resultant signal transmission problems.

Figure 3:
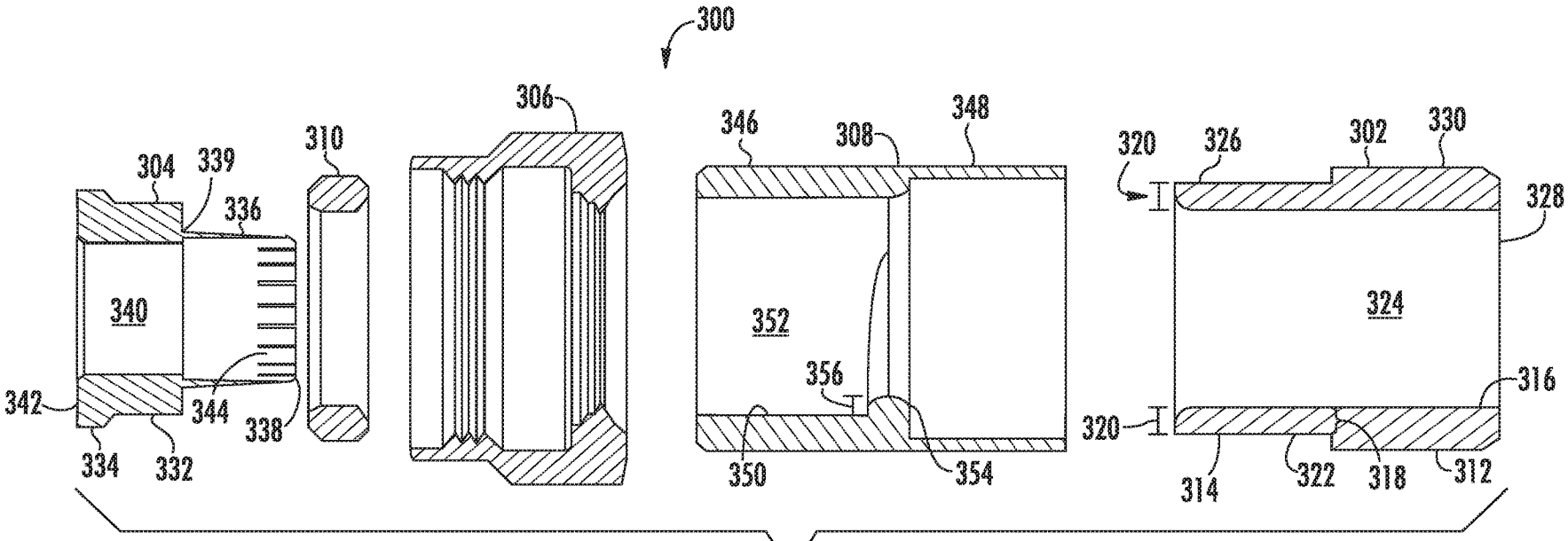
FIG. 3 is an exploded cross-sectional view of an exemplary embodiment of a coaxial cable connector for use with a coaxial cable prepared using the prepared coaxial cable of FIG. 2.
Figure 4:
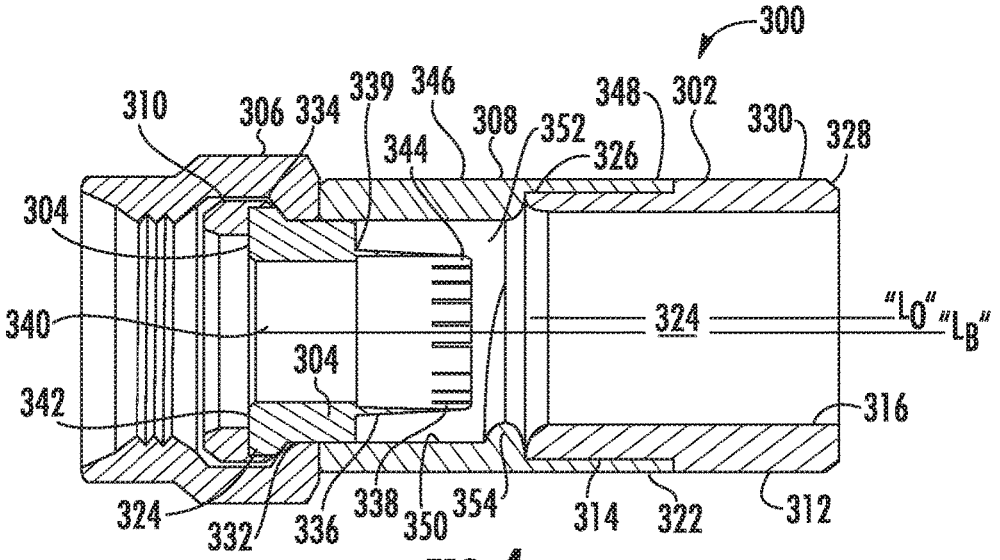
FIG. 4 is a cross-sectional view of the coaxial cable connector of FIG. 3 in an assembled state and an open condition without a coaxial cable inserted therein.
Figure 5:
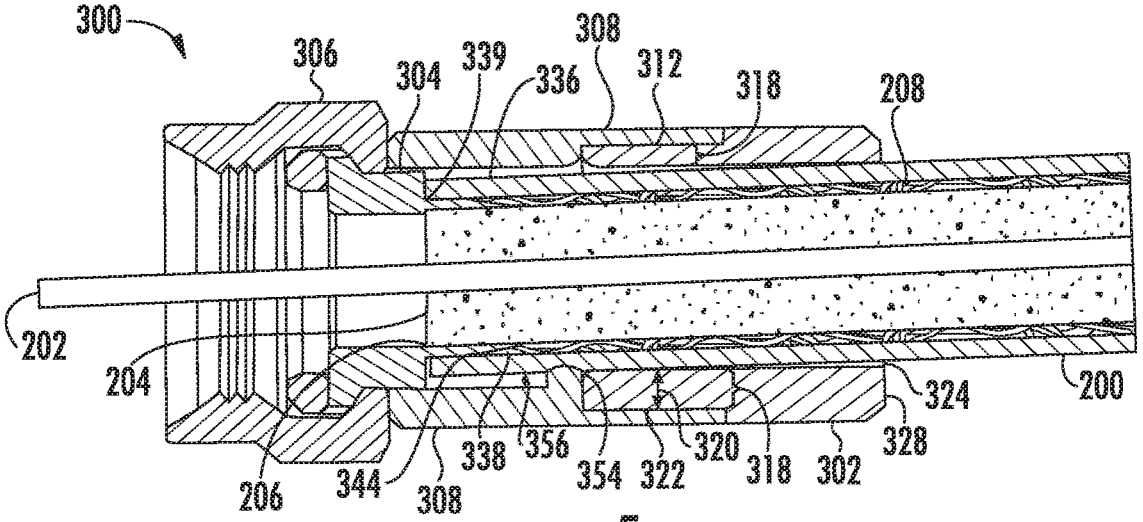
FIG. 5 is a cross-sectional view of the coaxial cable connector of FIG. 3 in an assembled state and an open condition with the prepared coaxial cable of FIG. 2 inserted therein.
Figure 6:
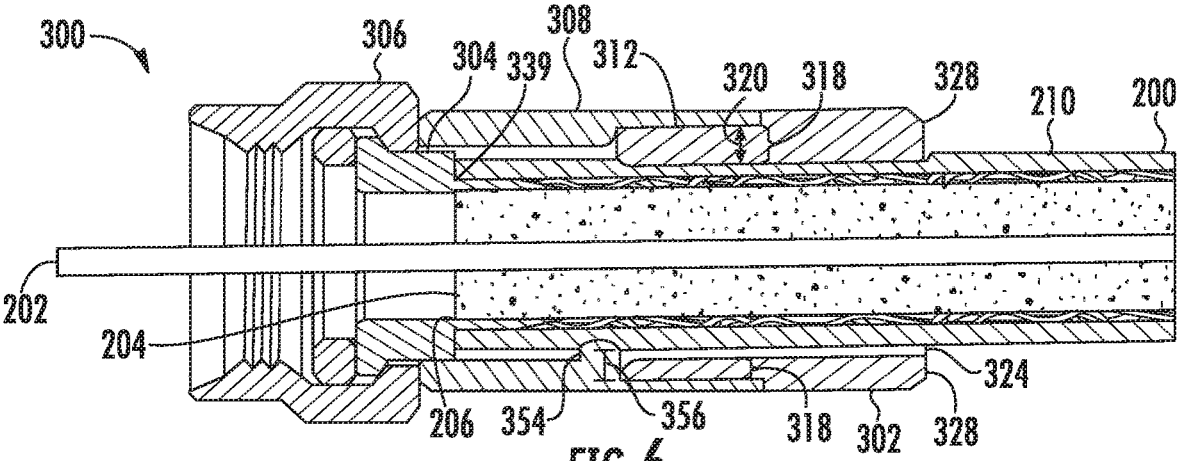
FIG. 6 is a cross-sectional view of the coaxial cable connector of FIG. 3 in an assembled state and a closed condition with the prepared coaxial cable of FIG. 2 inserted therein.

Referring now to FIGS. 3-6, exploded and assembled cross-sections of an exemplary embodiment of a coaxial cable connector 300 are shown. FIGS. 3 and 4 illustrate the coaxial cable connector 300 without a coaxial cable installed therein, with FIG. 4 illustrating the coaxial cable connector 300 in a connector open state. FIGS. 5 and 6 depict the coaxial cable connector 300 with the coaxial cable 200 inserted therein, and with the coaxial cable connector 300 in the connector open state (FIG. 5) and connector closed state (FIG. 6). As illustrated in FIGS. 3-6, the coaxial cable connector 300 may include a rotatable body segment 302, a post 304, a coupling member 306, a fixed body segment 308, and a gasket 310.

Figure 7:
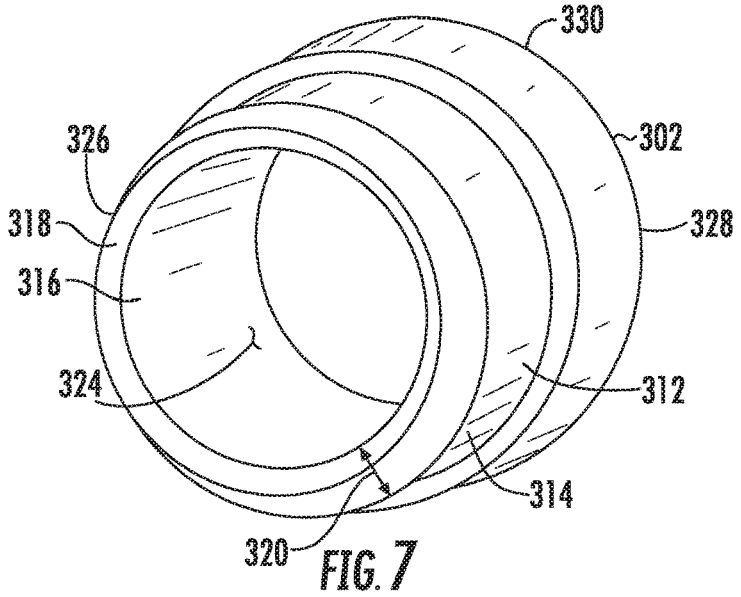
FIG. 7 is a rear perspective, detail view of a rotatable body segment of the coaxial cable connector of FIG. 3.

Referring to FIGS. 3 and 4, and also with particular reference to FIG. 7, which depicts a detail of the rotatable body segment 302, the rotatable body segment 302 has a body wall 312 with an outer surface 314 and an inner surface 316 defining a width 318 of the body wall 312 therebetween. The width 318 of the body wall 312 has a radial dimension 320 that varies along a perimeter 322 of the rotatable body segment 302. In other words, the body wall 312 has a variable width 318 around the perimeter 322 of the rotatable body segment 302. In this regard, the width 318 of the body wall 312 varies from narrow to wide around the perimeter 322 of the rotatable body segment 302, with the narrowest width, generally, being located diametrically opposite the widest width. The inner surface 316 defines a longitudinal opening 324 extending between a forward end 326 of the rotatable body segment 302 and a rearward end 328 of the rotatable body segment 302. The longitudinal opening 324 is centered along a longitudinal opening axis "$L_O$" and is adapted to receive a coaxial cable 200 (not shown in FIGS. 3 and 4) inserted in the coaxial cable connector 300. An annular shoulder 330 may extend radially outwardly from the rotatable body segment 302 proximal to the rearward end 328. As will be discussed in more detail below, when the rotatable body segment 302 is rotated, the widest and narrowest locations of the width 318 of the body wall 312 are oriented in such a way to cause the coaxial cable 200 to be secured in the coaxial cable connector 300. In this manner, the rotatable body segment 302 is rotated to close the coaxial cable connector 300 and secure the coaxial cable 200 in the coaxial cable connector 300. The rotatable body segment 302 may be constructed from any suitable material, including a thermoplastic polymer (polyoxymethylene), such as Acetal, as a non-limiting example.

Figure 8:
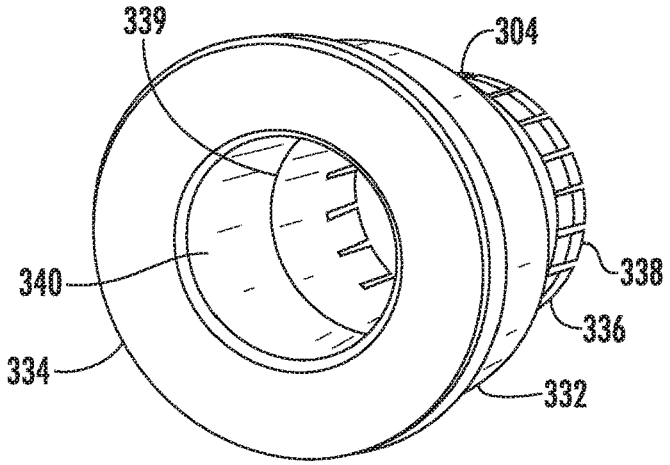
FIG. 8 is a front perspective, detail view of a post of the coaxial cable connector of FIG. 3.

Continuing with reference to FIGS. 3 and 4, but now also to FIG. 8 in which a detail of the post 304 is illustrated, the post 304 may position proximal the forward end 326 of the rotatable body segment 302 and is rotationally stationary with respect to the rotatable body segment 302. The post 304 may have a front section 332 with a first end 334 and a rear section 336 with a second end 338. The front section 332 and rear section 336 may meet at an interface 339. A bore 340 may extend between the first end 334 and the second end 338. The bore 340 of the post 304 is centered along a longitudinal bore axis "$L_B$" and is adapted to receive the coaxial cable 200 inserted in the coaxial cable connector 300. As illustrated particularly in FIG. 4, the longitudinal opening axis "$L_O$" and the longitudinal bore axis "$L_B$" may not be aligned when the coaxial cable connector 300 is in the connector open state, and as such may be transversely off-set from each other. The first end 334 may include a front face 342, while the second end 338 may include a plurality of spring tabs 344. The plurality of spring tabs 344 may be biased radially inwardly. In this manner, and, although not shown in FIGS. 3, 4 and 8, the plurality of spring tabs 344 may be used to stabilize the coaxial cable 200 inserted in the coaxial cable connector 300 by applying pressure against the jacket 210. The post 304 may be constructed from any suitable material, including metallic material, such as brass, as a non-limiting example, and plated with a corrosion resistant material, such as tin.

Figure 9:
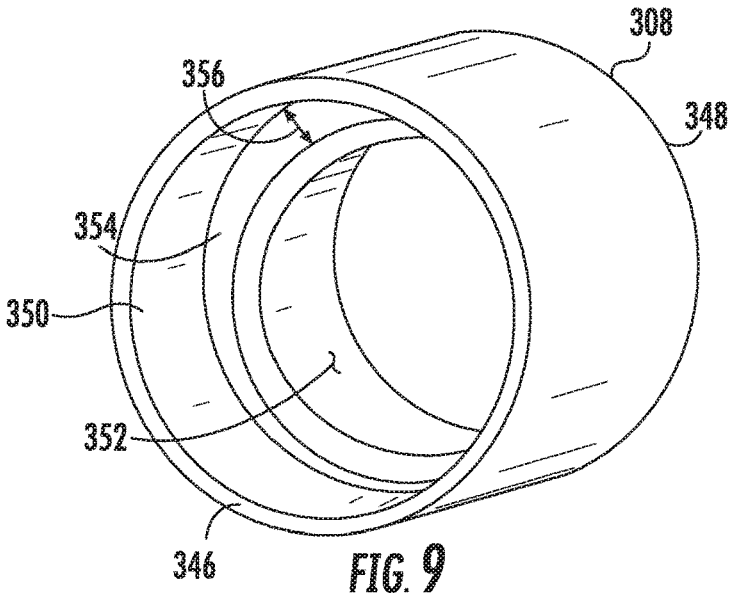
FIG. 9 is a front perspective, detail view of a fixed body segment of the coaxial cable connector of FIG. 3.

Still continuing with reference to FIGS. 3 and 4, and now also to FIG. 9, a detail of the fixed body segment 308 is illustrated. The fixed body segment 308 may have a front end 346 and a back end 348. In FIG. 4, the post 304 is friction fit to the front end 346 of the fixed body segment 308. As used herein, the term "friction fit" shall be understood to be the same as "interference fit" or "press fit", meaning or relating to the attachment of two parts or components by friction in response to the parts being put together. Additionally, the rotatable body segment 302 is rotationally attached to the back end 348 of the fixed body segment 308. The fixed body segment 308 may include an internal surface 350 defining a cable passage 352. A projection 354 may extend radially inwardly from a portion of the internal surface 350 of the fixed body segment 308 with a radially inward dimension 356 of the projection 354 that varies along the portion of the internal surface 350.

A coupling member 306 may position proximal to the first end 334 of the post 304, and may be a nut or any other suitable device for coupling the coaxial cable connector 300 to a terminal. The coupling member 306 may be constructed from any suitable material, including metallic material, for example brass, and plated with a corrosion resistant material, such as nickel. The gasket 310 may position in the coupling member 306 proximal the post 304 and provide environmental protection to the coaxial cable connector 300 when the coupling member 306 is attached to a terminal (not shown in FIGS. 3-6). The gasket 310 may be made from any suitable material, including a resilient polymer material such as ethylene propylene diene monomer (EPDM), as a non-limiting example.

Turning to FIGS. 5 and 6, the coaxial cable connector 300 is depicted with the coaxial cable 200 installed therein, in the connector open state and in the connector closed state, respectively. The rotatable body segment 302 is adapted to receive the coaxial cable 200 proximal the rearward end 328 with the coaxial cable 200 extending through the longitudinal opening 324, the cable passage 352 of the fixed body segment 308 and into the bore 340 of the post 304. In this regard, the coaxial cable 200 may extend through the cable passage 352 of the fixed body segment 308 from the back end 348 of the fixed body segment 308 through the front end 346 of the fixed body segment 308 and to the second end 338 of the post 304. The second end 338 of the post 304 is adapted to be inserted under the jacket 210 of the coaxial cable 200. The spring tabs 344 may bias against the jacket 210 of the coaxial cable 200 to provide a stable attachment of the coaxial cable 200 to the post 304. The inner conductor 202, the dielectric layer 204, and the braided outer conductor 208 may extend through the bore 340 in the post 304 toward the first end 334 of the post 304. However, the dielectric layer 204, the braided outer conductor 208 and the jacket 210 may stop at the interface 339 of the post 304, with the inner conductor 202 extending through the post 304 and into the coupling member 306.

With particular reference to FIG. 5, the coaxial cable connector 300 is shown in a connector open state with the rotatable body segment 302 being in a first configuration. In the first configuration, the width 318 of the body wall 312 is in a first orientation along the perimeter 322 of the rotatable body segment 302. As discussed above with respect to FIG. 4, in the connector open state, the longitudinal opening axis "$L_O$" and the longitudinal bore axis "$L_B$" may not be aligned and may be transversely off-set from each other. In this manner, the transverse off-setting of the longitudinal opening axis "$L_O$" and the longitudinal bore axis "$L_B$" provide for a wider opening of the longitudinal opening 324 of the rotatable body segment 302 and the cable passage 352 of the fixed body segment 308 to facilitate the receiving and extending of the coaxial cable 200 in the coaxial cable connector 300 from the rearward end 328 of the rotatable body segment 302 through the fixed body segment 308 to the post 304. In this regard, the rotatable body segment 302 is oriented so that the location on the perimeter 322 where the width 318 of the body wall 312 has a larger radial dimension 320, i.e., the width 318 is wider, is adjacent to a location where the projection 354 has the largest radial inward dimension 356. This aspect is graphically depicted in FIG. 5 as the larger radial dimension 320 being toward the bottom of the coaxial cable connector 300.

With particular reference to FIG. 6, the coaxial cable connector 300 is in a connector closed state with the rotatable body segment 302 being in a second configuration, the rotatable body segment 302 rotated to the second configuration to close the coaxial cable connector 300. In the second configuration, the width 318 of the body wall 312 is in a second orientation along the perimeter 322 of the rotatable body segment 302. In the connector closed state, the longitudinal opening axis "$L_O$" and the longitudinal bore axis "$L_B$" generally may be aligned and therefore not transversely off-set from each other. In this regard, the rotatable body segment 302 is oriented so that the location on the perimeter 322 where the width 318 of the body wall 312 has the larger radial dimension 320 is not adjacent to the projection 354. This aspect is graphically depicted in FIG. 6 as the larger radial dimension 320 being toward the top of the coaxial cable connector 300. As can be seen from FIG. 6, in the second configuration, the body wall 312 applies pressure to the jacket 210 of the coaxial cable 200, thereby gripping the coaxial cable 200 and forcing the coaxial cable 200 against the projection 354 so that the projection 354 also grips the jacket 210 of the coaxial cable 200. In this manner, the jacket 210 is gripped by the body wall 312 and the projection 354, and the coaxial cable 200 is secured in the coaxial cable connector 300 in response to the variable width 318 of the body wall 312 with the coaxial cable connector 300 in the connector closed state.

Figure 10:
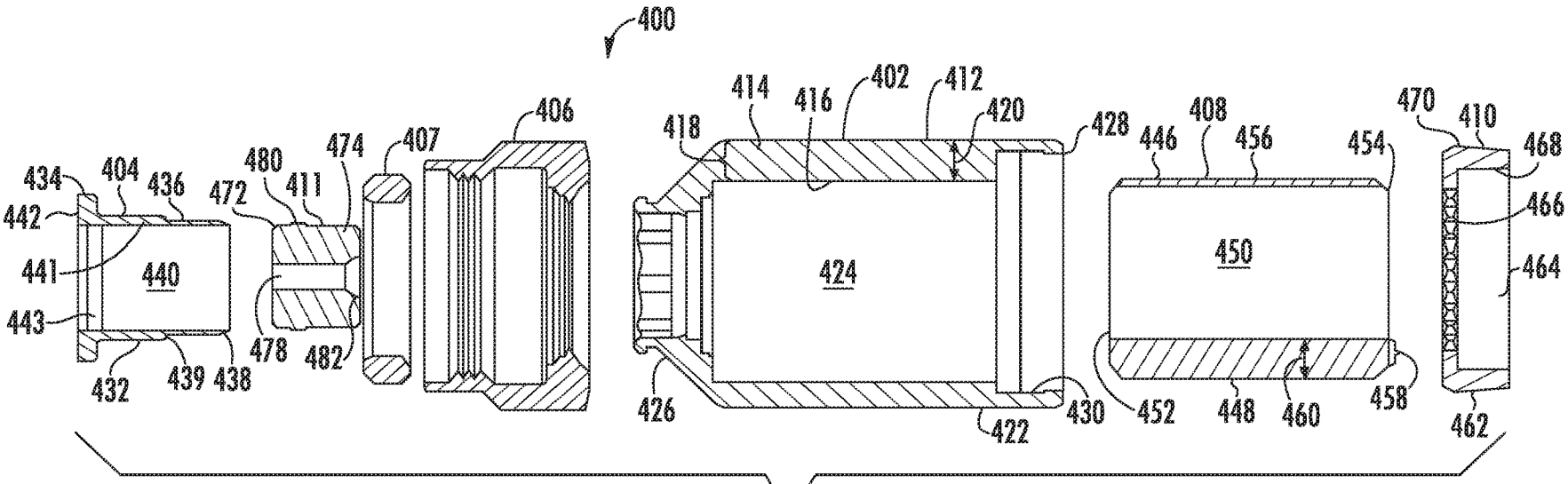
FIG. 10 is an exploded cross-sectional view of another exemplary embodiment of a coaxial cable connector for use with a coaxial cable prepared using the prepared coaxial cable of FIG. 2.
Figure 11:
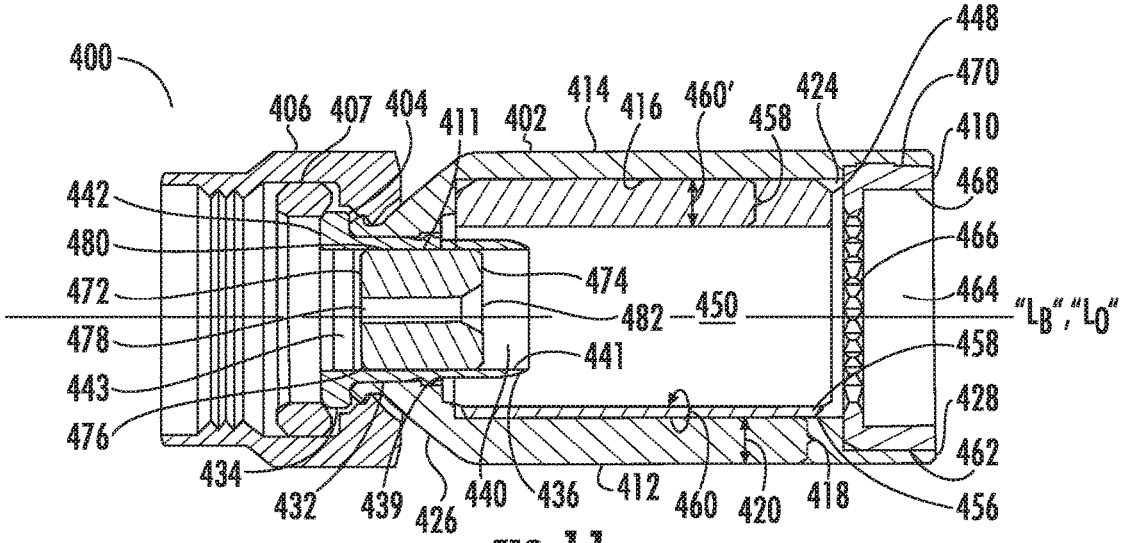
FIG. 11 is a cross-sectional view of the coaxial cable connector of FIG. 10 in an assembled state and an open condition without a coaxial cable inserted therein.
Figure 12:
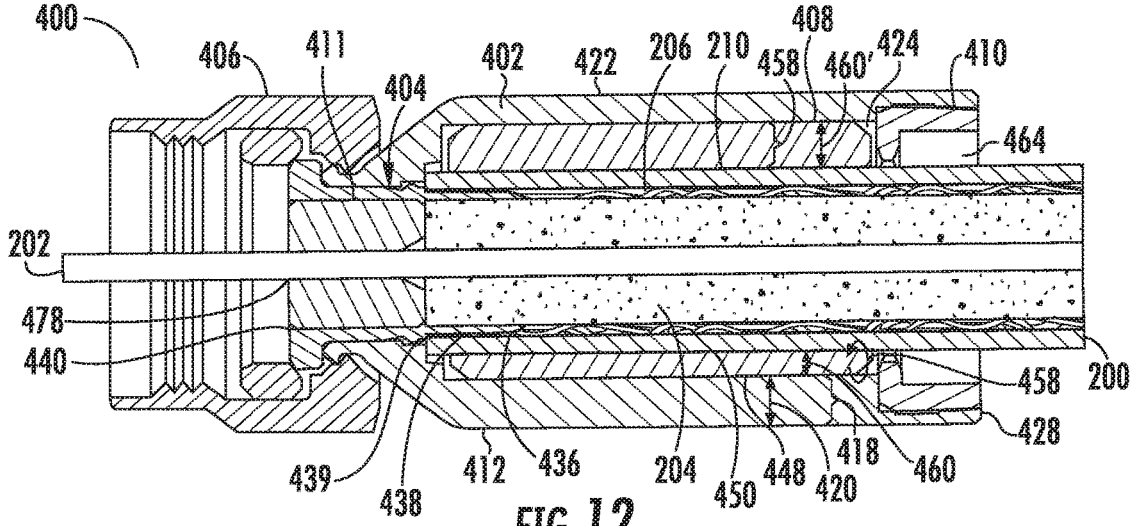
FIG. 12 is a cross-sectional view of the coaxial cable connector of FIG. 10 in an assembled state and an open condition with the prepared coaxial cable of FIG. 2 inserted therein.
Figure 13:
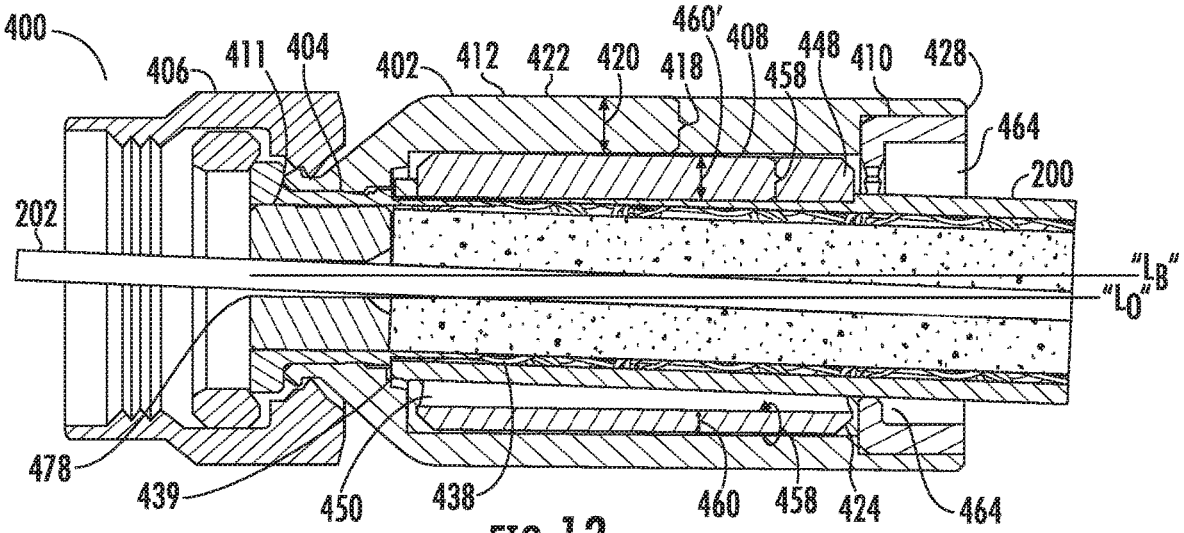
FIG. 13 is a cross-sectional view of the coaxial cable connector of FIG. 10 in an assembled state and a closed condition with the prepared coaxial cable of FIG. 2 inserted therein.

Referring now to FIGS. 10-13, exploded and assembled cross-sections of an exemplary embodiment of a coaxial cable connector 400 are shown. FIGS. 10 and 11 illustrate the coaxial cable connector 400 without a coaxial cable installed therein; and with FIG. 11 illustrating the coaxial cable connector 400 in a connector open state. FIGS. 12 and 13 depict the coaxial cable connector 400 with the coaxial cable 200 inserted therein, and with the coaxial cable connector 400 in the connector open state (FIG. 12) and connector closed state (FIG. 13). As illustrated in FIGS. 10-13, the coaxial cable connector 400 may include a rotatable body segment 402, a post 404, a coupling member 406, a gasket 407, a gripping insert 408, a ring 410 and an insulator 411.

Figure 14:
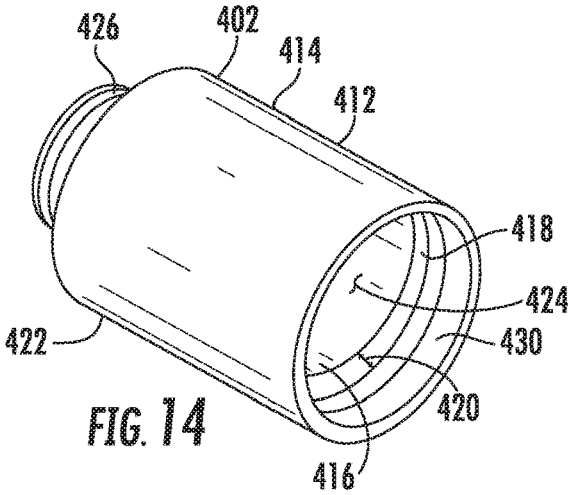
FIG. 14 is a rear perspective, detail view of a body of the coaxial cable connector of FIG. 10.

Referring to FIGS. 10 and 11, and also with particular reference to FIG. 14, which depicts a detail of the rotatable body segment 402, the rotatable body segment 402 has a body wall 412 with an outer surface 414 and an inner surface 416 defining a width 418 of the body wall 412 therebetween. In a similar fashion to the body wall 312 of the coaxial cable connector 300, the width 418 of the body wall 412 has a radial dimension 420 which varies along a perimeter 422 of the rotatable body segment 402. In other words, the body wall 412 has a variable width 418 around the perimeter 422 of the rotatable body segment 402. In this regard, the width 418 of the body wall 412 varies from narrow to wide around the perimeter 422 of the rotatable body segment 402, with the narrowest width, generally, being located diametrically opposite the widest width. The inner surface 416 defines a longitudinal opening 424 extending between a forward end 426 of the rotatable body segment 402 and a rearward end 428 of the rotatable body segment 402. The longitudinal opening 424 is centered along a longitudinal opening axis "$L_O$". The rotatable body segment 402 may have an annular channel 430 in the inner surface 416 proximal to the rearward end 428. As will be discussed in more detail below, when the rotatable body segment 412 is rotated, the widest and narrowest locations of the width 418 of the body wall 412 are oriented in such a way to cause the coaxial cable 200 to be secured in the coaxial cable connector 400. In this manner, the rotatable body segment 402 is rotated to close the coaxial cable connector 400 and secure the coaxial cable 200 in the coaxial cable connector 400. The rotatable body segment 402 may be constructed from any suitable material, including a thermoplastic polymer (polyoxymethylene), such as Acetal, as a non-limiting example.

Figure 15:
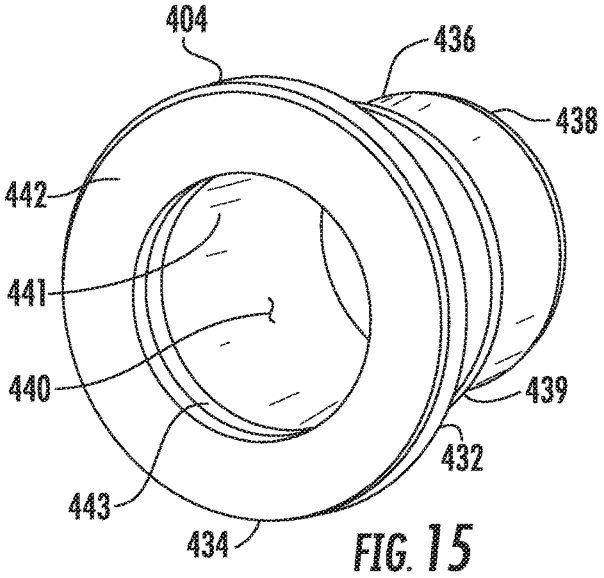
FIG. 15 is a front perspective, detail view of a post of the coaxial cable connector of FIG. 10.

Continuing with reference to FIGS. 10 and 11, but now also to FIG. 15 in which a detail of the post 404 is illustrated, the post 404 may position proximal the forward end 426 of the rotatable body segment 402 and is rotationally stationary with respect to the rotatable body segment 402. The post 404 may have a front section 432 with a first end 434 and a rear section 436 with a second end 438. The front section 432 and rear section 436 may meet at an interface 439. A bore 440 defined by an inner post surface 441 may extend between the first end 434 and the second end 438. The bore 440 of the post 404 is centered along a longitudinal bore axis "$L_B$" and is adapted to receive the coaxial cable 200 inserted in the coaxial cable connector 400. As illustrated particularly in FIG. 11, the longitudinal opening axis "$L_O$" and the longitudinal bore axis "$L_B$" may be generally aligned when the coaxial cable connector 400 is in the connector open state. However, longitudinal opening axis "$L_O$" and the longitudinal bore axis "$L_B$" may not be aligned in the connector open state as discussed above with respect to coaxial cable connector 300. The first end 434 may include a forward face 442 and a groove 443 in the inner post surface 441. The post 402 may be constructed from any suitable material, including metallic material, such as brass, as a non-limiting example, and plated with a corrosion resistant material, such as tin.

Figure 16:
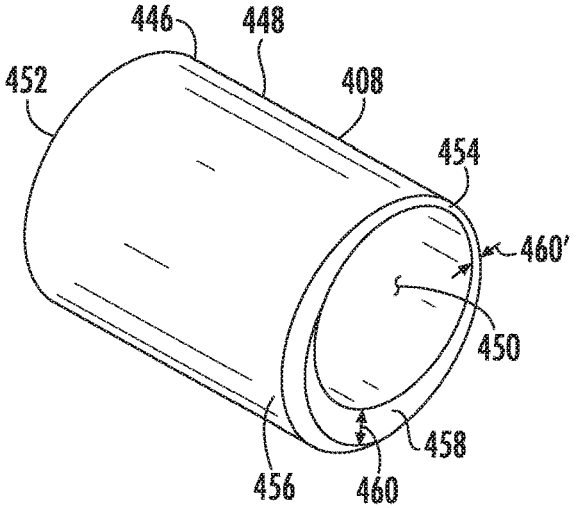
FIG. 16 is a rear perspective, detail view of a gripping insert of the coaxial cable connector of FIG. 10.

Still continuing with reference to FIGS. 10 and 11, and now also to FIG. 16, which illustrates a detail of the gripping insert 408. The gripping insert 408 may be a generally cylindrical structure 446 with a side 448 extending longitudinally about a hollow interior 450. The hollow interior 450 may extend between a front opening 452 and a rear opening 454, and wherein the side 448 has a circumferential surface, and wherein the gripping insert is rotationally stationary with respect to the rotatable body segment 402. The side 448 has a circumferential surface 456 and a width 458 with a side radial dimension 460 that varies around the circumferential surface 456 of the gripping insert 408. The gripping insert 408 may position in the longitudinal opening 424 of the rotatable body segment 402 and be rotationally stationary with respect to the rotatable body segment 402. The gripping insert 408 may be constructed from any suitable material, including a thermoplastic polymer (polyoxymethylene), such as Acetal, as a non-limiting example.

Figure 17:
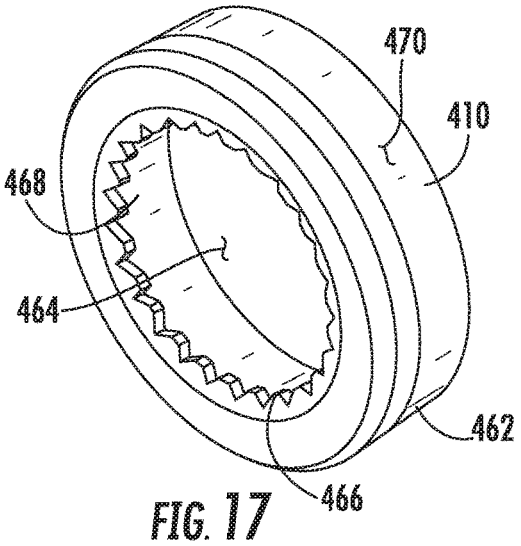
FIG. 17 is a front perspective, detail view of a ring of the coaxial cable connector of FIG. 10.

Still continuing with reference to FIGS. 10 and 11, and now also to FIG. 17, which illustrates a detail of the ring 410. The ring 410 includes a collar 462 around an orifice 464. A plurality of teeth 466 extend radially inwardly from an inner collar surface 468. The collar 462 may also have an outer collar surface 470 sized to fit within the annular channel 430 in the inner surface 416 of the rotatable body segment 402. The plurality of teeth 466 aid in retaining the coaxial cable 200 received by the rotatable body segment 402 as the coaxial cable 200 extends through the orifice 464. The ring 410 may be constructed from any suitable material, including a thermoplastic polymer (polyoxymethylene), such as Acetal, as a non-limiting example.

Figure 18:
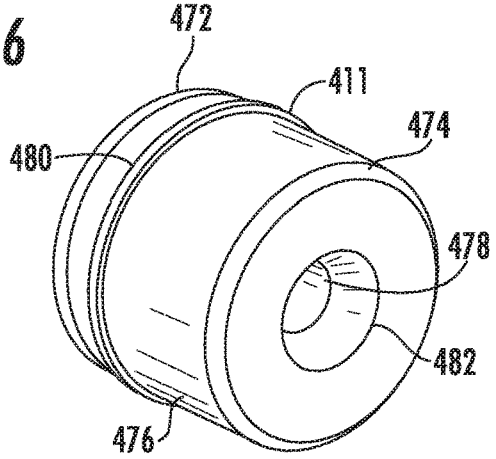
FIG. 18 is a rear perspective, detail view of an insulator of the coaxial cable connector of FIG. 10.

Referring also now to FIG. 18, the insulator 411 may have a forward side 472 and a rearward side 474, and an outer surface 476 in contact with the post 404, and a through-passage 478. As shown in FIGS. 10-13, the insulator 411 may slip fit into the bore 440 of the post 404 so that the insulator 411 may be allowed to move in the bore 440. At least one projection 480 extending radially outwardly from the outer surface 476 of the insulator 411 may locate in the groove 443 of the post 404 to limit movement of the insulator 411. In this manner, movement of the insulator 411 may be limited to the first end 434 of the post 404 so that the forward side 472 of the insulator 411 is flush with the forward face 442 of the post 404. The through-passage 478 opens at the forward side 472 and the rearward side 474. The through-passage 478 may open at the rearward side 474 in an angled or funnel-shaped rear opening 482. The through-passage 478 may be adapted to receive and guide the inner conductor 202 of the coaxial cable 200 at the rear opening 482. The insulator 411 may be constructed from any suitable material, including a thermoplastic polymer (polyoxymethylene), such as Acetal, as a non-limiting example.

The coupling member 406 may be positioned proximal to the first end 434 of the post 404, and may be a nut or any other suitable device for coupling the coaxial cable connector 400 to a terminal. The coupling member 404 may be constructed from any suitable material, including metallic material, for example brass, and plated with a corrosion resistant material, such as nickel. The gasket 407 may be positioned in the coupling member 406 proximal the post 404 and provide environmental protection to the coaxial cable connector 400 when the coupling member 406 is attached to a terminal (not shown in FIGS. 10-13). The gasket 407 may be made from any suitable material, including a resilient polymer material such as ethylene propylene diene monomer (EPDM), as a non-limiting example.

Turning to FIGS. 12 and 13, the coaxial cable connector 400 is depicted with the coaxial cable 200 installed therein, in the connector open state and in the connector closed state, respectively. The rotatable body segment 402 is adapted to receive the coaxial cable 200 proximal the rearward end 428. The coaxial cable 200 may extend through the orifice 464 of the ring 410 into and through the longitudinal opening 424 of the rotatable body segment 402, through the hollow interior 450 of the gripping insert 408, and into the bore 440 of the post 404. The dielectric 204, the braided outer conductor 208 and the jacket 210 may stop at the interface 439 of the post 404, with the inner conductor 202 of the coaxial cable 200 extending through the bore 440 of the post 404 and the through-passage 478 of the insulator 411 and to the coupling member 406. The second end 438 of the post 404 is adapted to insert under a jacket 210 of the coaxial cable 200.

With particular reference to FIG. 12, the coaxial cable connector 400 is shown in a connector open state with the rotatable body segment 402 being in a first configuration As discussed above, in the connector open state, the longitudinal opening axis "$L_O$" and the longitudinal bore axis "$L_B$" may be aligned. This may facilitate inserting the coaxial cable 200 through the orifice 464 of the ring 410, into and through the longitudinal opening 424 of the rotatable body segment 402, through the hollow interior 450 of the gripping insert 408, and into the bore 440 of the post 404. Additionally, in the first configuration, the width 418 of the body wall 412 is in a first orientation along the perimeter 422 of the rotatable body segment 402. The rotatable body segment 402 is oriented so that the location on the perimeter 422 where the width 418 of the body wall 412 having a larger radial dimension 420, i.e., the width 418 is wider, is adjacent to the side 448 of the gripping insert 408 with a width 458 having a smaller side radial dimension 460. This aspect is graphically depicted in FIGS. 11 and 12 as the larger radial dimension 420 of the width 418 of the body wall 412 being located at the bottom of the coaxial cable connector 400, adjacent to the side 448 of the gripping insert 408 with the width 458 having the smaller side radial dimension 460.

With particular reference to FIG. 13, the coaxial cable connector 400 is in a connector closed state with the rotatable body segment 402 being in a second configuration. In the second configuration, the rotatable body segment 402 has been rotated to the second configuration to close the coaxial cable connector 400. In this regard, the width 418 of the body wall 412 is in a second orientation along the perimeter 422 of the rotatable body segment 402. The rotatable body segment 402 is oriented so that the location on the perimeter 422 where the width 418 of the body wall 412 having the larger radial dimension 420 is not adjacent to the side 448 of the gripping insert 408 with the width 458 having a smaller side radial dimension 460. Instead, rotatable body segment 402 is oriented so that the location on the perimeter 422 where the width 418 of the body wall 412 having the larger radial dimension 420 is adjacent to the side 448 of the gripping insert 408 with the width 458 having a larger side radial dimension 460'. This aspect is graphically depicted in FIG. 13 as the larger radial dimension 420 of the width 418 of the body wall 412 being located at the top of the coaxial cable connector 400 adjacent to the side 448 of the gripping insert 408 with the width 458 having larger side radial dimension 460'.

As can be seen in FIG. 13, the longitudinal opening axis "$L_O$" and the longitudinal bore axis "$L_B$" may not be aligned when the coaxial cable connector 400 is in the connector closed state, and as such may be transversely off-set from each other. In this regard, the body wall 412 applies pressure to the side 448 of the gripping member 408 forcing the side 448 to grip the jacket 210 of the coaxial cable 200. Additionally, teeth 466 of ring 410 are also forced to grip the jacket 210 of the coaxial cable 200. In this manner, the gripping member 408 and the ring 410 grip the jacket 210 and secure the coaxial cable 200 in the coaxial cable connector 400 with the coaxial cable connector 400 in the connector closed state.

Figure 19:
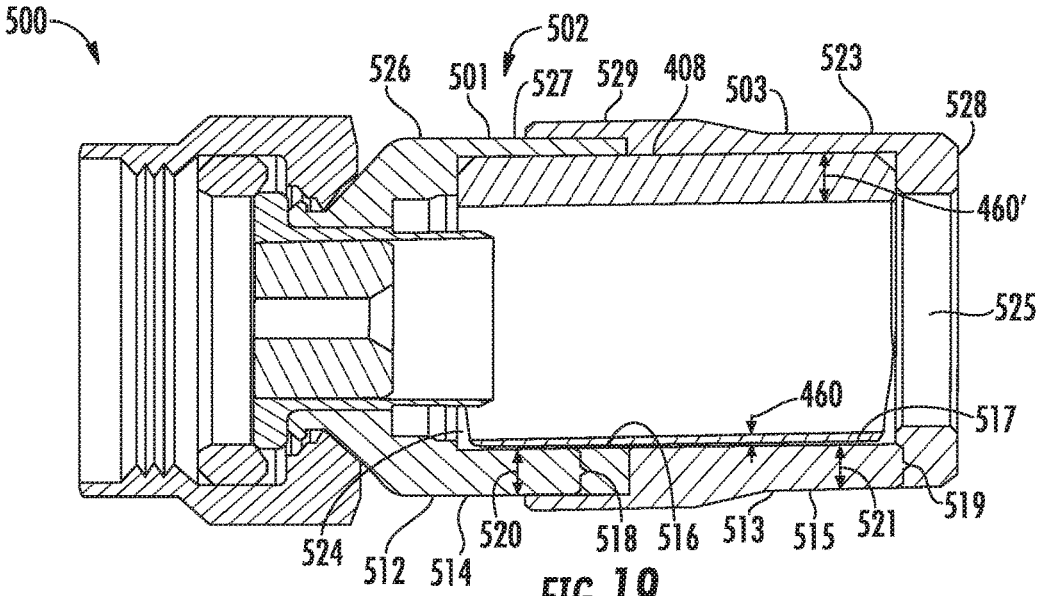
FIG. 19 is a cross-sectional view of another embodiment of a coaxial cable connector in an assembled state and an open condition without a coaxial cable inserted therein.
Figure 20:
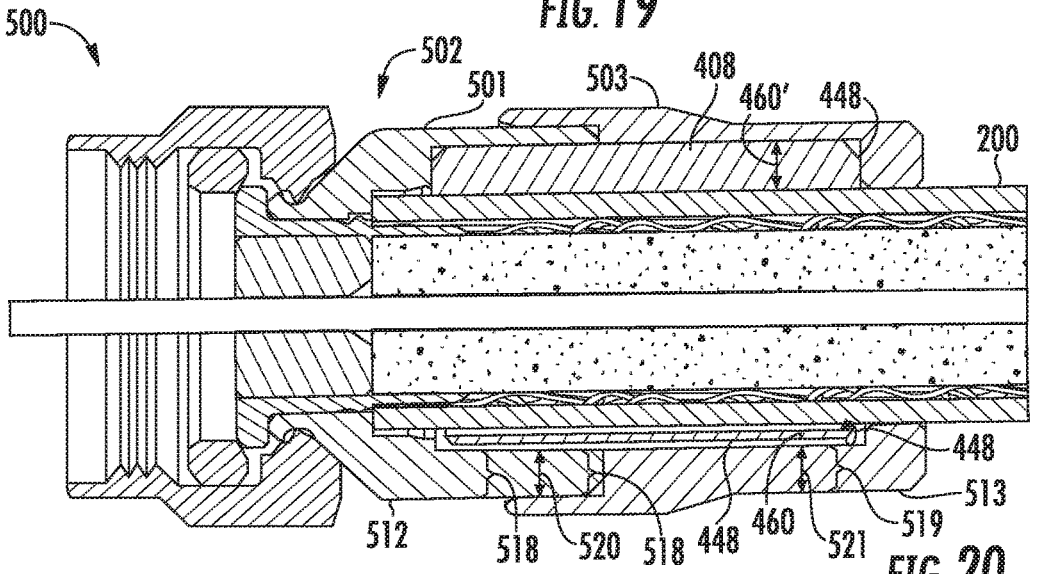
FIG. 20 is a cross-sectional view of the coaxial cable connector of FIG. 19 in an assembled state and an open condition with the prepared coaxial cable of FIG. 2 inserted therein.
Figure 21:
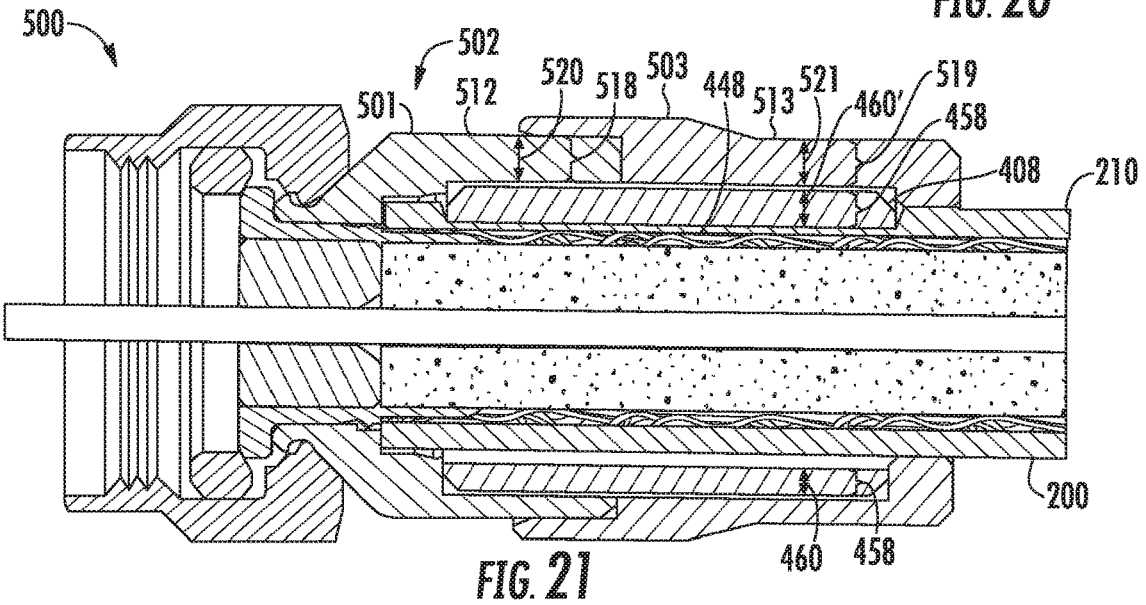
FIG. 21 is a cross-sectional view of the coaxial cable connector of FIG. 19 in an assembled state and a closed condition with the prepared coaxial cable of FIG. 2 inserted therein.

Referring now to FIGS. 19-21, cross-sections of an exemplary embodiment of a coaxial cable connector 500 are shown. FIG. 19 illustrates the coaxial cable connector 500 in a connector open state without a coaxial cable 200 installed therein. FIGS. 20 and 21 depict the coaxial cable connector 500 with the coaxial cable 200 inserted therein, and with the coaxial cable connector 500 in the connector open state (FIG. 20) and connector closed state (FIG. 21). Coaxial cable connector 500 is similar to coaxial cable connector 400 with the exception that the coaxial cable connector 500 has a rotatable body segment 502 which includes a front rotatable body segment 501 and a rear rotatable body segment 503. In addition, coaxial cable connector 500 may not include a ring 410. Therefore, except as necessary to describe the front rotatable body segment 501 and rear rotatable body segment 503, the discussion of aspects the coaxial cable connector 500 that are similar to the coaxial cable connector 400 will not be restated here with respect to coaxial cable connector 500.

Figure 22:
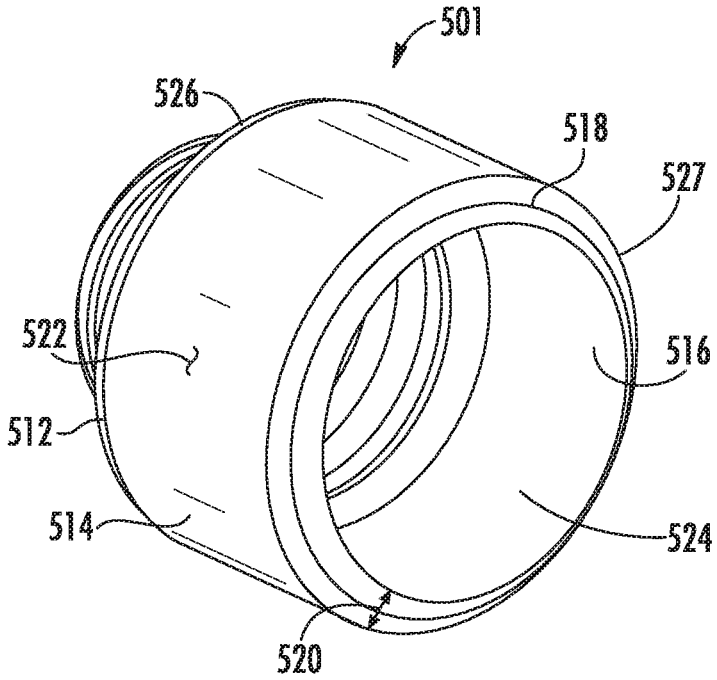
FIG. 22 is a rear perspective, detail view of a front body segment of the coaxial cable connector of FIG. 19.
Figure 23:
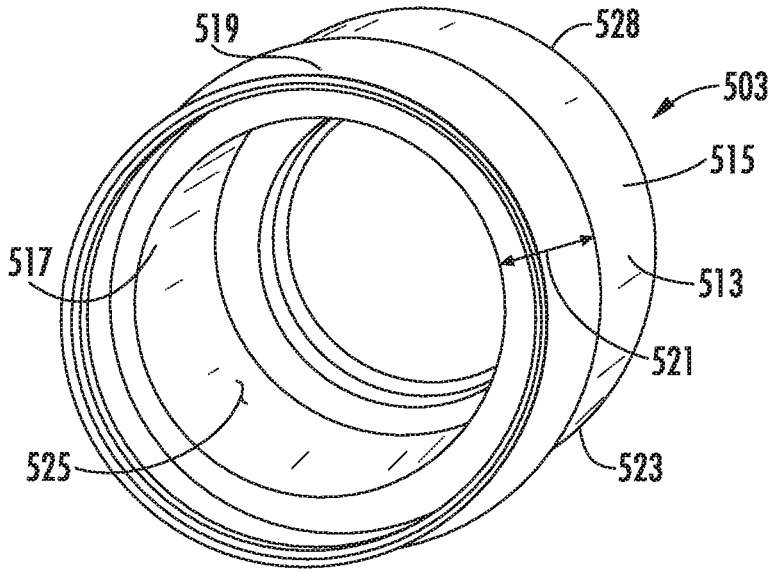
FIG. 23 is a front perspective, detail view of a rear body segment of the coaxial cable connector of FIG. 19.

Referring to FIG. 19, and also to FIGS. 22 and 23, the front rotatable body segment 501 and the rear rotatable body segment 503 will be discussed. The front rotatable body segment 501 has a forward end 526 and a mating rearward end 527. The rear rotatable body segment 503 has a mating forward end 529 and a rearward end 528. The front rotatable body segment 501 and the rear rotatable body segment 503 mate or attach to each other by the mating rearward end 527 of the first rotatable body segment 501 being friction fit to the mating forward end 529 of the second rotatable body segment 503. In this manner, the front rotatable body segment 501 and the rear rotatable body segment 503 may be rotated together.

The front rotatable body segment 501 has a front body wall 512 with a front outer surface 514 and a front inner surface 516 defining a front width 518 of the front body wall 512. The front width 518 of the front body wall 512 has a front radial dimension 520 which varies along a front perimeter 522 of the front rotatable body segment 502. In other words, the front body wall 512 has a variable width 518 around the front perimeter 522 of the front rotatable body segment 501. In this regard, the front width 518 of the front body wall 512 varies from narrow to wide around the front perimeter 522 of the front rotatable body segment 501, with the narrowest width, generally, being located diametrically opposite the widest width. The front inner surface 516 defines a front longitudinal opening 524 extending between the forward end 526 and the mating rearward end 527 of the front rotatable body segment 501. The rear rotatable body segment 503 has a rear body wall 513 with a rear outer surface 515 and a rear inner surface 517 defining a rear width 519 of the rear body wall 513.

As with the front body wall 512, the rear width 519 of the rear body wall 513 has a rear radial dimension 521 which varies along a rear perimeter 523 of the rear rotatable body segment 503. In other words, the rear body wall 513 has a variable rear width 519 around the rear perimeter 523 of the rear rotatable body segment 503. In this regard, the rear width 519 of the rear body wall 513 varies from narrow to wide around the rear perimeter 523 of the rear rotatable body segment 503, with the narrowest width, generally, being located diametrically opposite the widest width. The rear inner surface 517 defines a rear longitudinal opening 525 extending between the mating forward end 529 and the rearward end 528 of the rear rotatable body segment 503. The front inner surface 516 and the rear inner surface 517 align when the front rotatable body segment 501 is mated with the rear rotatable body segment 503. In this regard, the front longitudinal opening 524 and the rear longitudinal opening 525 form a continuous longitudinal opening from the forward end 526 to the rearward end 528. As will be discussed in more detail below, the rotatable body segment 502 formed by the front rotatable body segment 501 mated with the rear rotatable body segment 503 is rotated to close the coaxial cable connector 500 and secure the coaxial cable 200 in the coaxial cable connector 500. The front rotatable body segment 501 and the rear rotatable body segment 503 may be constructed from any suitable material, including a thermoplastic polymer (polyoxymethylene), such as Acetal, as a non-limiting example.

In assembling the coaxial cable connector 500, gripping insert 408 may position in the front longitudinal opening 524 prior to the front rotatable body segment 501 being mated to the rear rotatable body segment 503. The rear rotatable body segment 503 may then be mated with the front rotatable body segment 501 so that gripping insert 408 may position in front longitudinal opening 524 and the rear longitudinal opening 525. The gripping insert 408 may be rotationally stationary with respect to the rotatable body segment 502 formed by the front rotatable body segment 501 and the rear rotatable body segment 503.

With particular reference to FIG. 20, the coaxial cable connector 500 is shown in a connector open state with the rotatable body segment 502 being in a first configuration. In the first configuration, the width 518, 519 of body walls 512, 513 are in a first orientation along the perimeter 522, 523 of the front rotatable body segment 501 and rear rotatable body segment 503. The rotatable body segment 502 is oriented so that the location on the perimeter 522, 523 where the width 518, 519 of body walls 512, 513 of the rotatable body segment 502 having a larger radial dimension 520, 521 is located adjacent to the side 448 of the gripping insert 408 with the width 458 having a smaller side radial dimension 460. This aspect is graphically depicted in FIGS. 19 and 20 as the larger radial dimension 520, 521 of the width 518, 519 of body walls 512, 513 being located at the bottom of the coaxial cable connector 500, adjacent to the side 448 of the gripping insert 408 with a width 458 having a smaller side radial dimension 460.

Changing particular reference to FIG. 21, the coaxial cable connector 500 is in a connector closed state with the rotatable body segment 502 being in a second configuration. In the second configuration, the rotatable body segment 502, which includes the front rotatable body segment 501 and rear rotatable body segment 503, has been rotated to the second configuration to close the coaxial cable connector 500. In this regard, the width 518, 519 of the body wall 512, 513 is in a second orientation along the perimeter 522, 523 of the front rotatable body segment 501 and rear rotatable body segment 503. The rotatable body segment 502 is oriented so that the location on the perimeter 522, 523 where the width 518, 519 of the body wall 512, 513 of the rotatable body segment 502 having the larger radial dimension 520, 521 is not adjacent to the width 458 of the side 448 having a smaller side radial dimension 460. Instead, the width 518, 519 of the body wall 512, 513 of the rotatable body segment 502 is adjacent to the side 448 of the gripping insert 408 with the width 458 having a larger side radial dimension 460'. This aspect is graphically depicted in FIG. 21 as the larger radial dimension 520, 521 of the width 518, 519 of the body wall 512, 513 being located at the top of the coaxial cable connector 500 adjacent to the side 448 of the gripping insert 408 with the width 458 having the larger side radial dimension 460'.

As can be seen from FIG. 21, the body walls 512, 513 apply pressure to the side 448 of the gripping member 408 forcing the side 448 to grip the jacket 210 of the coaxial cable 200. In this manner, the gripping member 408 grips the jacket 210 and secures the coaxial cable 200 in the coaxial cable connector 500 with the coaxial cable connector 500 in the connector closed state.

Figure 24:
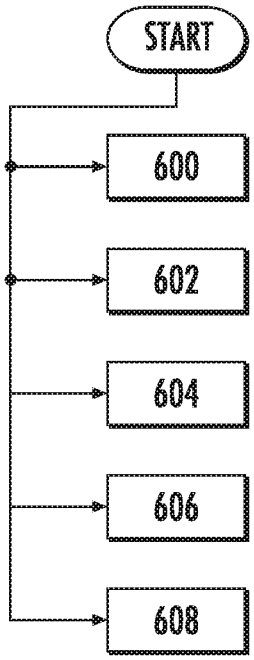
FIG. 24 is a flowchart diagram illustrating an exemplary process for preparing a coaxial cable and connecting the coaxial cable to a coaxial cable connector.

FIG. 24 depicts a method for preparing the coaxial cable 200 and connecting the coaxial cable 200 to the coaxial cable connector 300, 400, 500. The method may be implemented providing a coaxial cable 200 comprising an inner conductor 202, a dielectric layer 204 at least partially surrounding the inner conductor 202, an outer conductor 208 surrounding the dielectric layer 204, and a jacket 210 surrounding the outer conductor 208 (block 600); preparing the coaxial cable 200 by exposing a predetermined length of the inner conductor 202 beyond ends of the jacket 210, the dielectric layer 204, and the outer conductor 208, wherein the ends of the jacket 210, the dielectric layer 204, and the outer conductor 208 remain generally flush with each other (block 602); inserting the prepared coaxial cable 200 into a rotatable body segment 302, 402, 502 of a coaxial cable connector 300, 400, 500 proximal to a rearward end 328, 428, 528 of the rotatable body segment 302, 402, 502, the coaxial cable connector 300, 400, 500 being in a connector open state, and the rotatable body segment 302, 402, 502 is in a first configuration, a width 318, 418, 518, 519 of a body wall 312, 412, 512, 513 of the rotatable body segment 302, 402, 502 being in a first orientation along a perimeter 322, 422, 522, 523 of the rotatable body segment 302, 402, 502 (block 604); advancing the prepared coaxial cable 200 toward a forward end 326, 426, 526 of the rotatable body segment 302, 402, 502 to a post 304, 404 proximal the forward end 326, 426, 526 of the rotatable body segment 302, 402, 502, a second end 338, 438 of the post 304, 404 inserts under the jacket 210 of the coaxial cable 200, the inner conductor 202, the dielectric layer 204, and the outer conductor 208 extend through a bore 340, 440 in the post 304, 404 to a first end 334, 434 of the post 304, 404 (block 606); and putting the coaxial cable connector 300, 400, 500 in a connector closed state by rotating the rotatable body segment 302, 402, 502 to a second configuration, so that the width 318, 418, 518, 519 of the body wall 312, 412, 512, 513 is in a second orientation along the perimeter 322, 422, 522, 523 of the rotatable body segment 302, 402, 502 providing so that the coaxial cable 200 is secured in the coaxial cable connector 300, 400, 500 (block 608).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial cable connector for attachment to an end of a coaxial cable, the coaxial cable comprising an inner conductor, a dielectric at least partially surrounding the inner conductor, an outer conductor surrounding the dielectric, and a jacket surrounding the outer conductor, the coaxial cable connector comprising:

a rotatable body segment comprising a body wall having an outer surface and an inner surface defining a width of the body wall therebetween, wherein the body wall has a radial dimension that varies along a perimeter of the rotatable body segment, and wherein the inner surface defines a longitudinal opening extending between a forward end of the rotatable body segment and a rearward end of the rotatable body segment;

a post positioned proximal the forward end of the rotatable body segment, wherein the post comprises a first end and a second end with a bore extending therebetween, and wherein the post is rotationally stationary with respect to the rotatable body segment; and a coupling member positioned proximal to the first end of the post;

wherein the rotatable body segment is rotated to close the coaxial cable connector.

2. The coaxial cable connector of claim 1, wherein the post is friction fit to the rotatable body segment at the forward end.

3. The coaxial cable connector of claim 1, further comprising a fixed body segment, wherein the fixed body segment has a front end and a back end, and wherein the post is friction fit to the front end of the fixed body segment, and wherein the rotatable body segment is rotationally attached to the back end of the fixed body segment.

4. The coaxial cable connector of claim 3, wherein the fixed body segment comprises an internal surface defining a cable passage.

5. The coaxial cable connector of claim 4, wherein a projection extends radially inwardly from a portion of the internal surface of the fixed body segment.

6. The coaxial cable connector of claim 5, wherein a radially inward dimension of the projection varies along the portion of the internal surface.

7. The coaxial cable connector of claim 6, wherein the projection grips the jacket of the coaxial cable in response to the radial dimension of the width of the body wall and the radially inward dimension of the projection with the coaxial cable connector in a connector closed state.

8. The coaxial cable connector of claim 1, further comprising a gripping insert positioned in the longitudinal opening of the rotatable body segment.

9. The coaxial cable connector of claim 8, wherein the gripping insert comprises a generally cylindrical structure with a side extending longitudinally surrounding a hollow interior extending between a front opening and a rear opening, and wherein the side has a circumferential surface, and wherein the gripping insert is rotationally stationary with respect to the rotatable body segment.

10. The coaxial cable connector of claim 9, wherein the side of the gripping insert has a width with a side radial dimension that varies around the circumferential surface of the gripping insert.

11. The coaxial cable connector of claim 10, wherein the gripping insert grips the jacket of the coaxial cable in response the body wall applying pressure to the side of the gripping insert with the coaxial cable connector in a connector close state.

12. The coaxial cable connector of claim 11, wherein the rotatable body segment comprises a front rotatable body segment and a rear rotatable body segment, and wherein the front rotatable body segment and the rear rotatable body segment are friction fit to each other.

13. The coaxial cable connector of claim 1, further comprising a ring positioned in the rotatable body segment proximal the rearward end.

14. The coaxial cable connector of claim 13, wherein the ring comprises a plurality of teeth extending radially inwardly, and wherein the plurality of teeth aid in retaining the coaxial cable received by the coaxial cable connector.

15. The coaxial cable connector of claim 1, further comprising an insulator disposed in the bore of the post.

16. The coaxial cable connector of claim 15, wherein the insulator comprises a through-passage, and wherein the inner conductor of the coaxial cable extends through the through-passage to the coupling member.

17. A coaxial cable connector for attachment to an end of a coaxial cable, the coaxial cable comprising an inner conductor, a dielectric at least partially surrounding the inner conductor, an outer conductor surrounding the dielectric, and a jacket surrounding the outer conductor, the coaxial cable connector comprising:

a rotatable body segment comprising a body wall having an outer surface and an inner surface defining a width of the body wall, wherein the body wall has a variable width along a perimeter of the rotatable body segment, and wherein the inner surface defines a longitudinal opening extending between a forward end of the rotatable body segment and a rearward end of the rotatable body segment, and wherein the longitudinal opening is centered along a longitudinal opening axis;

a post positioned proximal the forward end of the rotatable body segment, wherein the post comprises a first end and a second end with a bore extending therebetween, and wherein the bore of the post is centered along a longitudinal bore axis, and wherein the post is rotationally stationary with respect to the rotatable body segment; and a coupling member positioned proximal to the first end of the post;

wherein, in a connector open state, the rotatable body segment is in a first configuration, wherein the variable width of the body wall is in a first orientation along the perimeter of the rotatable body segment; and wherein, in a connector closed state, the rotatable body segment is in a second configuration, wherein the variable width of the body wall is in a second orientation along a perimeter of the rotatable body segment.

18. The coaxial cable connector of claim 17, wherein in the connector open state, the rotatable body segment is adapted to receive a coaxial cable at the rearward end, and wherein the coaxial cable extends through the longitudinal opening and into the bore of the post, and wherein the second end of the post is adapted to insert under a jacket of the coaxial cable.

19. The coaxial cable connector of claim 18, wherein in the connector closed state, the variable width of the body wall in the second orientation along the perimeter of the rotatable body segment provides an off-set cam effect between the rotatable body segment and the post, with the longitudinal opening axis and the longitudinal bore axis being angularly displaced.

20. The coaxial cable connector of claim 19, further comprising a fixed body segment comprising a projection extending radially inwardly from a portion of an internal surface of the fixed body segment, wherein the projection is adapted to grip the jacket of the coaxial cable received by the rotatable body segment in response to the variable width of the body wall in the second orientation along the perimeter of the rotatable body segment.

21. The coaxial cable connector of claim 19, further comprising a gripping insert comprising a generally cylindrical structure with a side extending longitudinally, wherein the side has a circumferential surface having a width with a side radial dimension that varies around the circumferential surface of the gripping insert, wherein the gripping insert is adapted to grip the jacket of the coaxial cable received by the rotatable body segment in response to the variable width of the body wall in the second orientation along the perimeter of the rotatable body segment.

* * * * *